US005201567A

United States Patent [19]

Beasley

[11] Patent Number: 5,201,567

[45] **Date of Patent: * Apr. 13, 1993**

[54] STORABLE SEATING UNIT

[75] Inventor: Kim A. Beasley, Alexandria, Va.

[73] Assignee: Paralyzed Veterans of America, Washington, D.C.

[ * ] Notice: The portion of the term of this patent subsequent to Jan. 28, 2009 has been disclaimed.

[21] Appl. No.: 815,520

[22] Filed: Jan. 2, 1992

Related U.S. Application Data

[63] Continuation of Ser. No. 579,548, Sep. 10, 1990, Pat. No. 5,083,386.

[51] Int. Cl.[5] ..... A47C 1/121

[52] U.S. Cl. ..... 297/335; 297/13; 297/232; 297/349

[58] Field of Search ..... 297/13, 142, 162, 232, 297/240, 331, 335, 349; 248/145

[56] References Cited

U.S. PATENT DOCUMENTS

| | | | |
|---|---|---|---|
| 941,983 | 11/1909 | Elsner | 297/335 X |
| 1,007,041 | 10/1911 | Miller | 297/335 X |
| 1,015,799 | 1/1912 | Mazen | 297/375 X |
| 1,318,439 | 10/1919 | Erickson | 297/13 |
| 2,604,925 | 7/1952 | Swift | 297/349 X |
| 3,191,400 | 6/1965 | Swenson | 297/349 |
| 3,275,283 | 9/1966 | Rauch | 297/349 X |
| 3,708,203 | 1/1973 | Barecki | 297/349 X |

*Primary Examiner*—Peter R. Brown

*Attorney, Agent, or Firm*—Oblon, Spivak, McClelland, Maier & Neustadt

[57] ABSTRACT

A storable seating unit for access by an individual in a wheelchair to seating in a stadium or arena. The storable seating unit includes a pedestal, a seat bottom pivotally connected to the pedestal, and a seat back pivotally mounted to one of the seat back and the pedestal. The pedestal includes a mechanism for pivoting the seat bottom and the seat back so as to define an open area for positioning of the wheelchair in a position occupied by the seat bottom and the seat back prior to pivoting. The pedestal may include a longitudinal slot and a slide pivotally and slidably positioned therein and connected to the seat bottom and the seat back for pivoting of the seat bottom and the seat back and lowering thereof along the length of the slide.

9 Claims, 3 Drawing Sheets

STORABLE SEATING UNIT

This is a continuation of application Ser. No. 07/579,548, filed on Sep. 10, 1990, issued as U.S. Pat. No. 5,083,386.

BACKGROUND OF THE INVENTION

1. Field of the Invention

The present invention is directed to a storable seating unit for access by a wheelchair such as, for example, stadium seats or arena seats.

2. Discussion of the Background

It is well understood that seating for handicapped individuals in wheelchairs is difficult to provide in stadiums and arenas due to the rigid structure of the fixed seating, leaving little or no flexibility of seating to accommodate individuals who may be handicapped and require a wheelchair. Thus there has been a strong desire for providing storable stadium seating which has the flexibility of accommodating individuals of all types while providing a uniform design and being aesthetically pleasing. Heretofore it has been necessary to designate special areas to accommodate only individuals in wheelchairs, which areas are basically in the form of open areas near guardrails, these areas being dispersed throughout designated areas of stadiums and arenas and thus not allowing handicapped individuals to be seated with individuals who are not handicapped. Thus, handicapped individuals have not been able to easily socialize with non-handicapped individuals during events occurring at stadiums and arenas. There has therefore been recognized a need for providing seating which allows handicapped individuals to mix socially with others and to do so in an easy and convenient manner without drawing attention to their disabilities and without obstructing entrances and exits.

SUMMARY OF THE INVENTION

Accordingly, the present invention serves to answer the problems which have previously existed in stadiums, arenas and auditoriums while answering the need for an aesthetically pleasing appearance of all seating within the stadium. The seating design in accordance with the present invention is intended to replicate the more conventional seating found in stadiums and similar facilities. This design, however, allows for a unique folding and storage to permit a wheelchair user to have access to general seating areas.

The seating unit is mounted, in accordance with one embodiment, on a double pedestal for independent operation of each seat. The seats may fold up in a conventional manner, then pivot about the axis of the pedestal upon which it is mounted until it drops into the pedestal sleeve or slides along the axis thereof by provision of a slot in the sleeve. It is intended to provide for easy operation, a minimal number of parts, low maintenance and safe use by patrons utilizing the facility.

The folding action of the seating unit in accordance with the present invention can also be designed to fold in another manner, i.e., the seat back may be folded down to the seat bottom, then flip up by the pivot connection of the seat bottom to the pedestal and slide down the pedestal to achieve a similar storage capability.

DETAILED DESCRIPTION OF THE PREFERRED EMBODIMENTS

Figure 1:
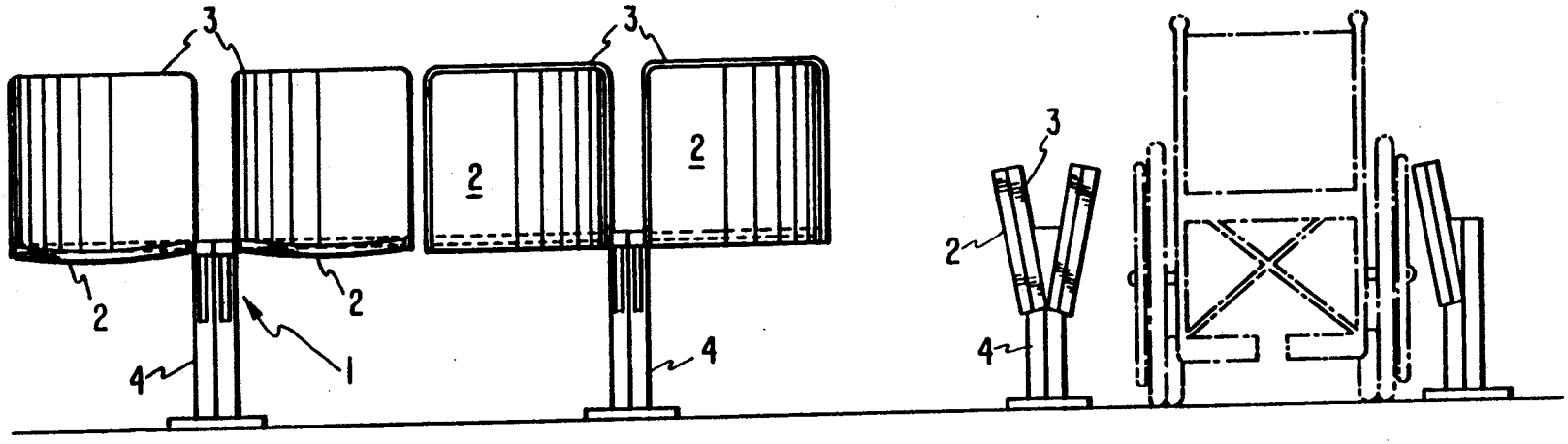
FIG. 1 is an elevational view of a row of seating units with one unit being folded up to accommodate an individual in a wheelchair in accordance with the present invention.
Figure 2:
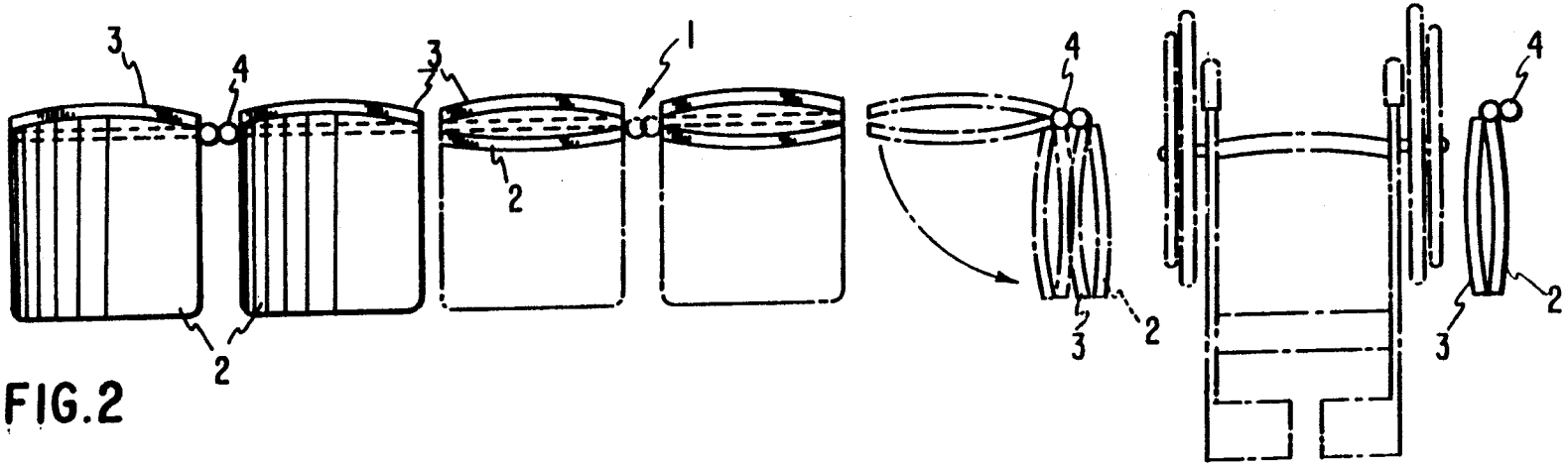
FIG. 2 is a top view of FIG. 1 illustrating the manner in which the seating unit seat and back are pivotally mounted to the pedestal for providing access to an opening by an individual in a wheelchair.
Figure 3:
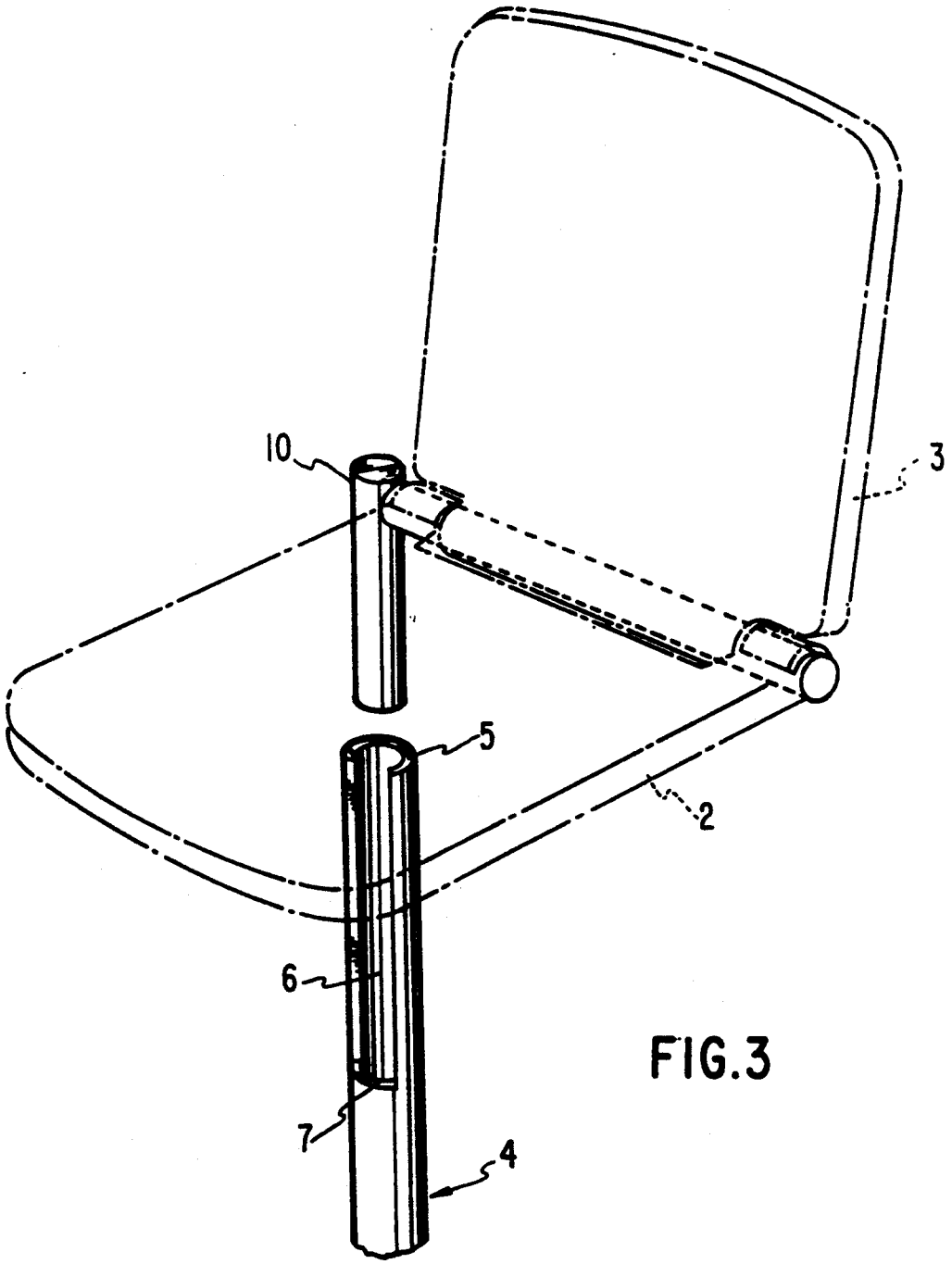
FIG. 3 shows details of the pedestal and associated seating unit in accordance with the present invention.

With reference to the Figures demonstrating preferred embodiments of the present invention, it is to be noted that a seating unit 1 includes a seat bottom 2 and seat back 3 with the seat being pivotally mounted to the seat back to tilt upward in a manner normally found in stadium seating. However, in order to provide further access to the space above the stadium floor occupied by the seat, when necessary, for accommodating an individual in a wheelchair, it is possible, in accordance with the present invention, to further pivot the seat bottom 2 and seat back 3 as a unit about a vertical pivot member accommodated within a pedestal member 4. The pedestal member 4 is characterized by a longitudinal slot within which the combined seat and seat back is slidable via an L-shaped slide 10 upon being pivoted forwardly as illustrated in FIG. 2 so as to disengage from a ledge 5 of the pedestal member 4 and then register with a slot 6. The combined seat and seat back is then allowed to be guided downwardly along the slot 6 in the pedestal member 4 until reaching a stop member 7 which defines a lower, stored position of the folded seat. As illustrated in FIG. 1, the thus folded seat forms a compact unit that serves to provide adequate space for an individual in a wheelchair, who can thus attend stadium and arena events with other individuals who are seated in regular seating adjacent him or her.

Figure 4:
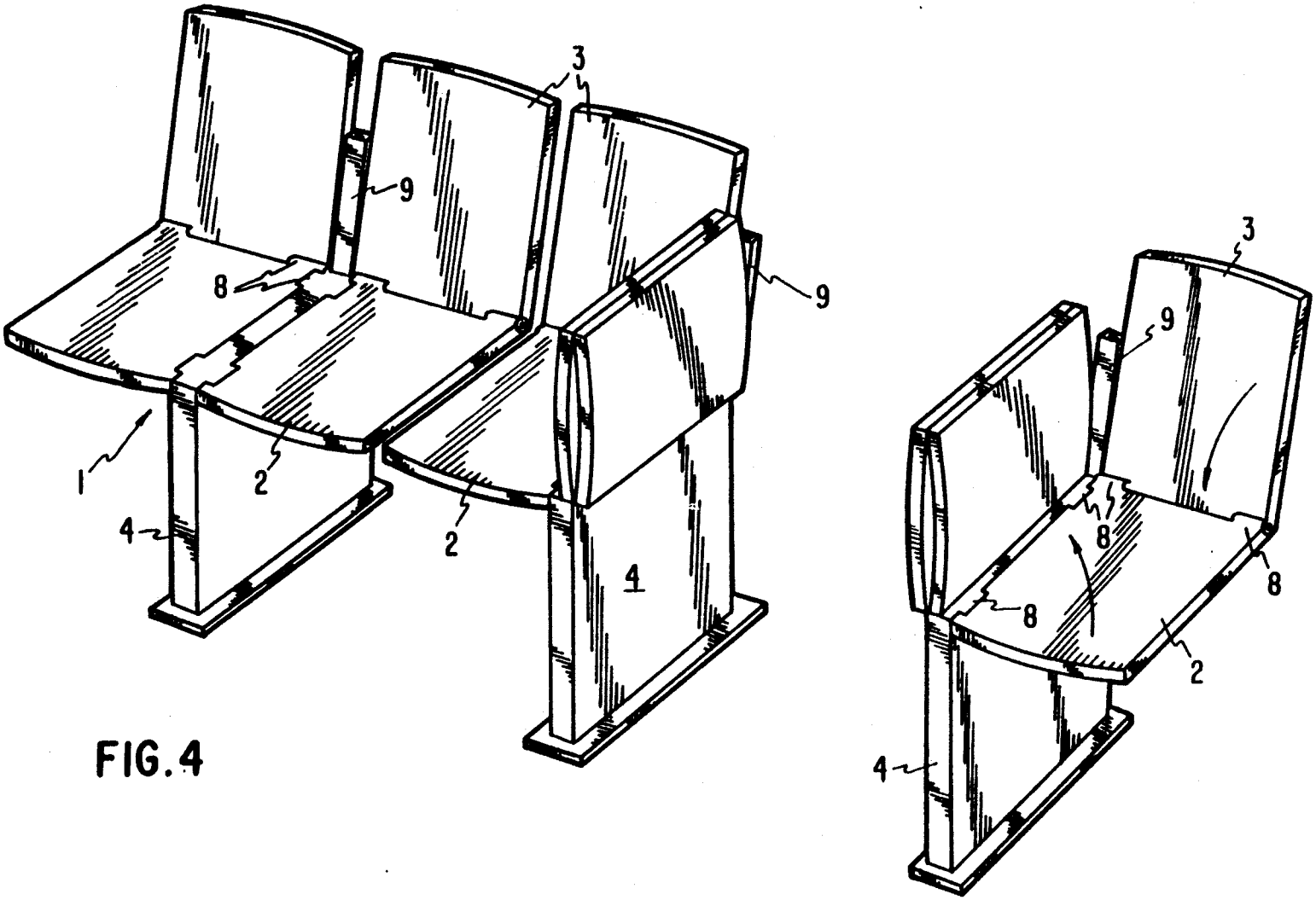
FIG. 4 illustrates a second embodiment of the present invention.

As must be understood, variations on this embodiment are possible. For instance, that illustrated in FIG. 4 demonstrates that it is possible to pivotally connect the seat back 3 to the seat bottom 2 by pivot members 8, 8. Upon folding down of the seat back 3 seat onto the seat bottom 2, the entire seating unit 1 can be pivoted about the pivot members 8, 8 by means of its connection with the pedestal member 4 in an upward direction so as to be vertically oriented as illustrated in FIG. 4. This orientation also serves to accommodate an individual in a wheelchair on either side of the pedestal member 4, if necessary. Of course, it is also possible to modify this structure to have the seat back 3 pivot down on top of the seat bottom 2 and to have this combination to pivot up to be aligned with the pedestal member 4. Pivotable arms 9 could also be used, which would be pivotably connected either to the pedestal member 4 or to the seat back 3 so as to be storable if needed.

Obviously, numerous modifications and variations of the present invention are possible in light of the above teachings. It is therefore to be understood that, within the scope of the appended claims, the invention may be practiced otherwise than as specifically described herein.

What is claimed as new and designed to be secured by Letters Patent of the United States is:

1. A storable seating unit comprising:

(a) an at least approximately vertical pedestal member in the form of a hollow pipe having a central axis, said hollow pipe having a first abutment surface and a second abutment surface angularly spaced about said central axis from said first abutment surface;

(b) an L-shaped slide comprising:

(i) an at least approximately vertical leg received in said hollow pipe and sized and shaped to slide vertically therein and (ii) an at least approximately horizontal leg connected to the upper end of said at least approximately vertical leg of said L-shaped slide and extending radially outwardly of said hollow pipe;

(c) a seat back mounted on said at least approximately horizontal leg of said L-shaped slide;

(d) a seat bottom comprising a first tubular bearing means that is pivotably mounted on said at least approximately horizontal leg of said L-shaped slide for pivotable movement of said seat bottom relative to said at least approximately horizontal leg of said L-shaped slide into a position juxtaposed against said seat back, whereby said storable seating unit can be manipulated back and forth between:

(e) a first position in which:

(i) said L-shaped slide is supported by said first abutment surface and (ii) said seat bottom and said seat back are pivoted away from each other, allowing a person to sit in said storable seating unit, and (f) a second position in which:

(i) said L-shaped slide is supported by said second abutment surface and (ii) said seat bottom and said seat back are juxtaposed against each other.

2. A storable seating unit as recited in claim 1 wherein said at least approximately vertical leg of said L-shaped slide and said at least approximately horizontal leg of said L-shaped slide are connected rigidly to each other.

3. A storable seating unit as recited in claim 1 wherein said at least approximately vertical leg of said L-shaped slide is pivotable relative to said hollow pipe about said central axis.

4. A storable seating unit as recited in claim 1 wherein said seat back comprises a second tubular bearing means that is pivotably mounted on said at least approximately horizontal leg of said L-shaped slide for pivotable movement of said seat back relative to said at least approximately horizontal leg of said L-shaped slide.

5. A storable seating unit as recited in claim 1 wherein said first abutment surface is an at least approximately horizontal ledge at the upper end of said hollow pipe.

6. A storable seating unit as recited in claim 5 wherein said second abutment surface is the bottom of an at least approximately vertically extending slot in said hollow pipe.

7. A storable seating unit as recited in claim 1 wherein said second abutment surface is the bottom of an at least approximately vertically extending slot in said hollow pipe.

8. A storable seating unit as recited in claim 1 wherein said second abutment surface is longitudinally spaced along said central axis from said first abutment surface.

9. A storable seating unit as recited in claim 1 wherein the interior of said hollow pipe and said at least approximately vertical leg are cylindrical in cross-section.

* * * * *